United States Patent [19]

Billette de Villemeur

[11] Patent Number: 4,652,075

[45] Date of Patent: Mar. 24, 1987

[54] RESILIENT REMOVABLE ELECTRICAL TERMINAL-CONNECTOR

[76] Inventor: Philippe M. Billette de Villemeur, 6, rue de la Cossonnerie, 75001 Paris, France

[21] Appl. No.: 696,370

[22] Filed: Jan. 30, 1985

[51] Int. Cl.[4] ..... H01R 13/10

[52] U.S. Cl. ..... 339/256 R; 339/258 R

[58] Field of Search ..... 339/256 R, 256 S, 258 R, 339/258 P

[56] References Cited

U.S. PATENT DOCUMENTS

| | | | |
|---|---|---|---|
| 3,141,724 | 7/1964 | Raymond | 339/256 R |
| 3,504,331 | 3/1970 | Anderson | 339/256 R |
| 3,771,113 | 11/1973 | Cronce | 339/256 C |

*Primary Examiner*—Joseph H. McGlynn

*Attorney, Agent, or Firm*—Sughrue, Mion, Zinn, Macpeak and Seas

[57] ABSTRACT

The electrical terminal-connector comprises at least one tubular contact portion suitable for being removably fixed by elastic deformation to a terminal (10). The tubular contact portion is formed by rolling a substantially rectangular blank of flat sheet metal so that its ends overlap in order to form a substantially spiral winding. The terminal-connector includes a tab (5) cut out close to one end of the spiral and folded through a window (6) cut through the adjacent turns, with the length of the tab being sufficient to extend radially from the other face of the tube formed by the spiral in such a manner as to be able to ensure contact with a terminal (10). The window (6) is sufficiently wide to enable the tab (5) to move from side to side as the spiral is tightened or loosened.

8 Claims, 12 Drawing Figures

RESILIENT REMOVABLE ELECTRICAL TERMINAL-CONNECTOR

The present invention relates to a resilient removable connector for electrical terminal. The invention is equally applicable to female connectors for engaging on male terminals and male connectors for engaging in hollow tubular terminals. The invention is particularly, but not exclusively, applicable to connectors for use with spark plugs in internal combustion engines.

BACKGROUND OF THE INVENTION

One of the properties looked for in such connectors is good electrical contact: it is thus desirable for the contact member to be resiliently applied with as great a force as possible. The connector must thus be deformable. A second desired property is that the connector should be deformed as little as possible when being put in place. Thus, for example, connectors for motorcar spark plugs are sometimes removed at an angle relative to the axis of the connector (because of difficulty of access) and this can permanently deform the connector by exceeding its elastic limit. The connector can then no longer be used. Connectors are provided with locking means to limit their deformation in order to avoid this situation. Finally, such connectors must be a snap-fit. After being pushed into place using a reasonable amount of force, they must remain securely snap-fitted to the terminal.

Finally, manufacturing costs should be as low as possible. Thus, where possible, the connector should be made in one piece. This is also favorable from the reliability point of view.

Male-female or female-male connections have already been made for applying high contact pressures. However, they either require both connector portions to be suitable for very limited deformation only, thereby requiring both portions to have corresponding tight tolerances in their dimensions and further requiring accurate handling, or else such connectors require a mechanism or shape which is bulky, e.g. a lyre shape, or finally the connection may comprise a plurality of parts, one for tightening and another for making contact, in other words an extra locking member is required.

Preferred embodiments of the present invention provide a terminal-connector capable of applying a high clamping force and capable of a high degree of deformation, e.g. three to five times that which is current in this type of connector component.

SUMMARY OF THE INVENTION

The present invention provides an electrical terminal-connector comprising at least one tubular contact portion suitable for being removably fixed by elastic deformation to a terminal, said portion being formed by rolling a blank of flat metal sheet which is substantially rectangular so that its ends overlap in order to form a substantially spiral winding, the terminal-connector including the improvement wherein a tab is cut out close to one end of the spiral and is folded through a window cut through the adjacent turns, the length of the tab being sufficient to extend radially from the other face of the tube formed by the spiral in such a manner as to be able to ensure contact with the terminal, the window being sufficiently wide to enable the tab to move from side to side therein as the spiral is tightened or loosened.

The end of the tab folded through the spiral thus constitutes not only an electrical contact member, but also a locking member for limiting the elastic deformation of the connector, and a snap- or clip-fastening member. When the connector is deformed by a force, the spiral tightens or loosens depending on the effect of the force, and elastic deformation is limited by the folded tab abutting against one or other of the sides of the window.

To ensure sufficiently flexible electrical contact, the end of the tab must radially extend noticeably proud from the window. In accordance with the invention, the degree to which the tab so extends is greater than or equal to the thickness of the metal blank from which the connector is formed.

In order to facilitate placing the connector on a terminal, the tab is formed with at least one insertion slope at an angle of about 20° to 40° which may be formed either by suitably cutting of the blank or else by suitably folding the blank. The connector may also advantageously include a snap-fastening slope, opposite to the preceding shape and forming an angle of not more than 90°, and preferably of 40° to 60°.

It will be seen from the following description that the connector behaves like a spiral spring with only a portion of it being used during elastic deformation. The proportion of the length of the spiral which is used depends on the number of turns which it includes, and this length varies in steps (i.e. discretely) as a function of the number of turns for numbers of turns $n+\frac{1}{2}$.

The window made through the metal reduces the resilient strength of the connector, and in accordance with a preferred feature of the present invention, the extent of the window in the direction parallel to the connector axis is less than or equal to one-third of the length of the connector when the spiral includes one and a half turns, and less than or equal to three-fourths of that length when the spiral includes less than one and a half turns. As is shown below, the effect of the window cutout is not the same in both cases.

In order to allow the connector to deform elastically as the spiral tightens or loosens, the tab passing through the window must be capable of moving towards an edge of the window or towards the opposite edge. Preferably, the width of the window in the direction perpendicular to the axis of the connector is equal to the sum of the circumferential width of the tab plus at least three times the possible radial displacement thereof, i.e. the degree to which the tab stands proud from the window.

BRIEF DESCRIPTION OF THE DRAWINGS

Embodiments of the invention are described by way of example with reference to the accompanying drawings, in which.

MORE DETAILED DESCRIPTION

Figure 1:
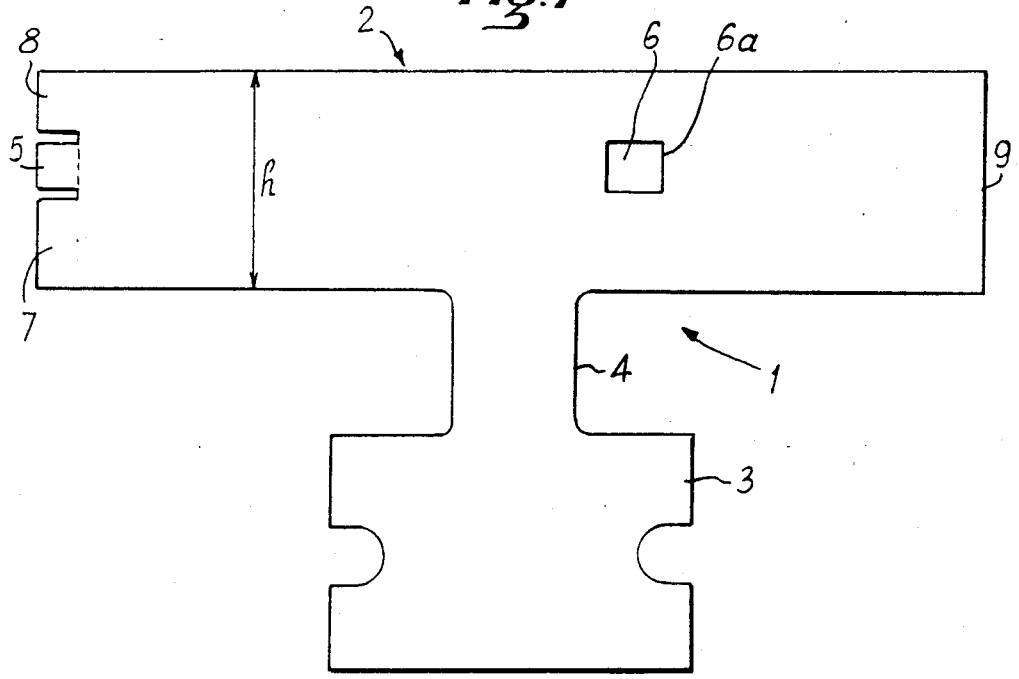
FIG. 1 is a plan view of a flexible sheet metal blank cut to constitute a connector in accordance with the invention after being rolled up.
Figure 2:
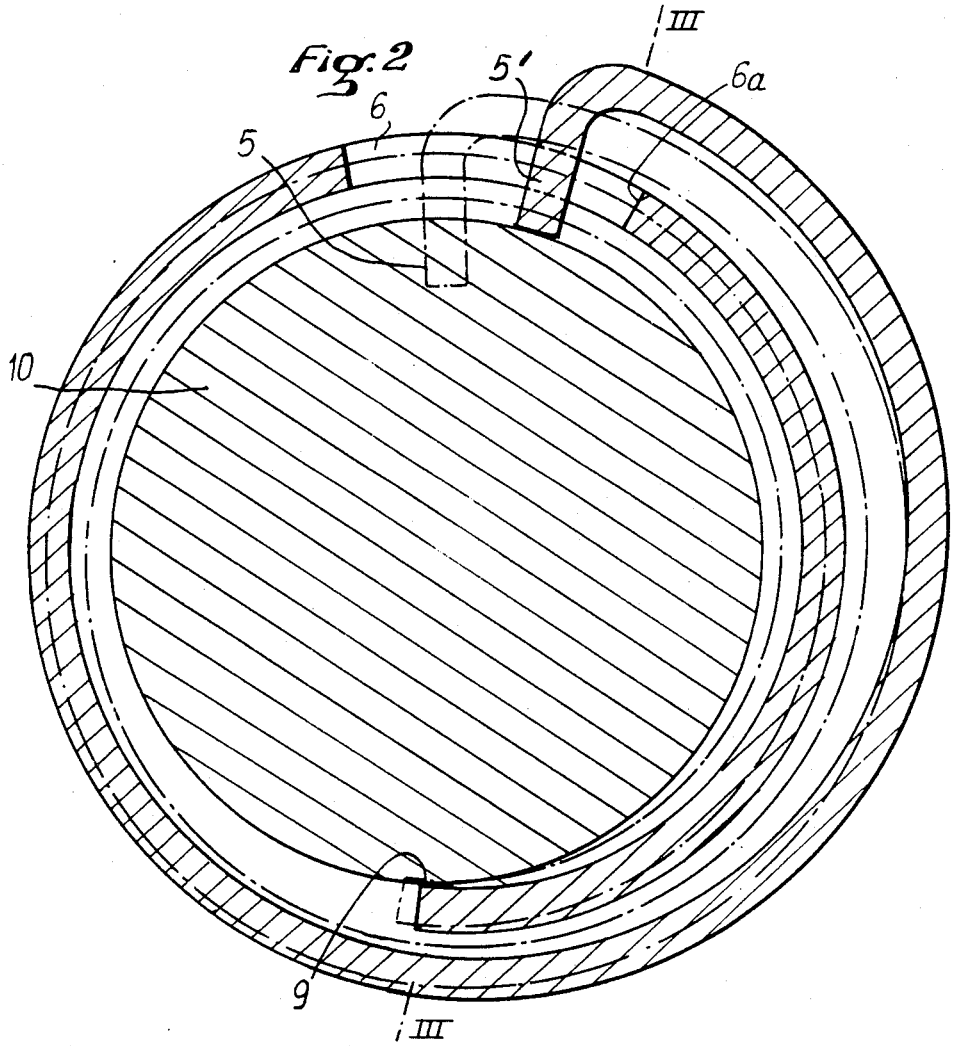
FIG. 2 is a section view perpendicular to the axis of a connector in accordance with the invention as formed by rolling up in FIG. 1 blank, dashed lines show the connector in the free or relaxed state and solid lines show the connector as elastically deformed after being placed a terminal.

The blank 1 shown in FIG. 1 comprises a substantially rectangular portion 2 for constituting a connector 20 in accordance with the invention. It may also include a portion 3 for fixing to a cable and a link portion 4 between the two portions 2 and 3. The connector could alternatively be used without portions 3 and 4, being, for example, directly soldered or welded to a conductor. At the far left of the portion 2 as shown in FIG. 1, there is a cut-out tab 5 which is folded so as to be capable of passing through a window 6 when the rectangular portion 2 is rolled into a spiral (see FIG. 2). The wings 7 and 8 on either side of the tab 5 may be left or they may be removed. In order to form a connector in accordance with the invention, the rectangle 2 is rolled up into a spiral as shown in the section of FIG. 2 so as to constitute a sleeve or a tube. If the tab 5 is situated at the outside end of the spiral, it is folded inwardly (see FIG. 2). If the tab 15 is situated at the inside end of the spiral (see FIG. 7) it is folded outwardly. The first case provides a female connector suitable for engaging a male terminal. The second case provides a male connector suitable for engaging in a hollow terminal.

FIG. 2 is a section perpendicular to the axis of a female connector formed with the tab 5 at the outer end of the spiral. The dashed line shows a section through the connector in the free or relaxed state with the tab 5 projecting a considerable distance inwardly. When the connector is engaged on a terminal 10, the tab 5 is pushed outwardly and takes up a position 5' shown in solid lines in FIG. 2. The tab moves outwardly and at the same time the spiral unwinds, thus moving the tab 5 across the window 6. The window must therefore be wide enough to enable the tab 5 to move freely without impeding its resilient motion in either direction. Advantageously, the width of the window is equal to not less than the sum of the thickness of the tab (in the circumferential direction) plus three times the maximum displacement thereof, i.e. three times the distance which it projects inwardly into the connector. In order to ensure elastic contact with the terminal 10, the tab 5 must extend radially inside the connector by a distance which is equal to not less than the thickness of the metal constituting the connector.

When the connector is maximally deformed, for example by being inclined relative to the terminal, the tab 5 abuts against the edge 6*a* of the window 6 and the connector cannot become any larger. It is locked. The connector is thus protected against being deformed by an excessive force.

As will be readily understood, and as is shown in FIG. 2, the terminal 10 is resiliently clamped between the edge 5*a* of the tab 5 and the edge 9 of the rectangle 2 from the blank 1. The resilient force ensuring electrical contact between the connector and the terminal as exerted by these two points on the terminal is developed over the entire length of the spiral between these two points, which amounts to one and a half turns in the example shown in FIG. 2. The connector is thus very flexible and electrical contacts can be assured with wide tolerances on the diameter of the terminal.

Figure 3:
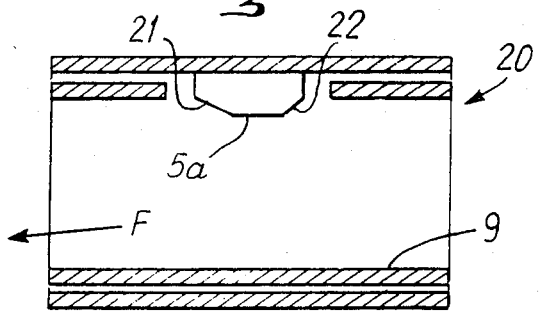
FIG. 3 is a longitudinal section view of the FIG. 2 connector, on a line III—III of the FIG. 2.

In order to facilitate pushing the connector 20 home over a terminal 10, in the direction of an arrow F in FIG. 3, it is advantageous to provide a slope 21 of about 20° to about 40° on the tab. This slope may be obtained by suitably cutting the blank, or else by folding over a corner of the metal. In the examples shown in FIGS. 1 to 3, cutting is preferable. For a connector intended for fixing to a motorcar spark plug, the tab 5 engages resiliently in the groove formed on the spark plug terminal. In order to be able to remove the connector without difficulty, it is advantageous to provide a removal ramp 22, opposite to the ramp 21 and which may have an angle in the range 40° to 90°, e.g. 60°. In this case, electrical contact may also be established by one or other of the slopes 21 and 22 or by both of them, in addition to the contacts provided by the level edge 5*a*. Simultaneously, the tab 5 serves as a snap-fastening finger for the connector, providing that suitable means, such as a groove, are available on the terminal. Clearly, in a variant, the tab could have a groove and the terminal could have a ridge for snap-fitting therewith.

It can thus be seen from the above description that the tab 5 performs the following functions simultaneously;

(1) resilient electrical contact;

(2) locking the connector against excessive opening out or crushing; and (3) a snap-fastening finger.

Thus the invention provides a single-piece metal connector which provides all three required functions.

Figure 4:
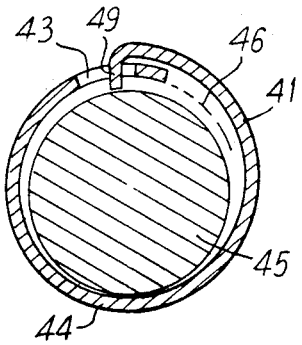
FIG. 4 is a section view perpendicular to the axis of a second connector in accordance with the invention, shown in the deformed state on a terminal.

FIG. 4 is a section on a blank perpendicular to the axis showing a connector 41 which is formed by rolling a blank over slightly more than one turn, but considerably less than one and one half turns. The connector is constituted by a shorter spiral and includes a tab 42 engaged through a window 43. The terminal 45 on which the connector 41 is engaged is resiliently clamped between the tab 42 and diametrically opposite point 44. In this case, it can be seen that the length of spring providing the clamping force on the terminal is one half turn of the connector-forming spiral. A possible extension 46 of the spiral would not effect the spring force unless the extension extends the length of the spiral to one turn and a half, i.e. so long as the inside end of the spiral has not reached the point diametrically opposite to the tab as it projects into the connector. As a result, with increasing length of spiral, the effective length of the spiral for clamping the electrical connection increases in discrete steps which are 0.5, 1.5, 2.5, etc. turns. In particular, a spiral of length 1 to 1.5 turns is effective over a length of 0.5 turns, a spiral of length 1.5 to 2.5 turns is effective over a length of 1.5 turns, etc.

It may also be observed that in the FIG. 4 case, the portion of the spiral which provides the resilient force is the portion lying between the tab 42 and the opposite point 44, which portion does not include the window 43. Thus, in embodiments where the spiral includes less than one and one half turns, the portion of the spiral which is effected by the resilient force does not include a window. From this, it can be seen that in the FIG. 4 case of less than 1.5 turns, the weakness caused to the connector by the window cutout has no effect on the resilient terminal-clamping force. Even so, it is reasonable to limit the size of the window whose edge still serves to limit elastic deformation. Thus, in this case the size of the window in the direction of the connector axis may be less than or equal to three quarters of the length of the connector (i.e. the dimension h in FIG. 1). However, if the spiral continues for 1.5 turns or more, the window lies in a portion of the connector which acts as a spring and so its extent in the axial direction should be less than or equal to one third of the length of the connector.

FIGS. 5 to 12 show three other variants of connectors in accordance with the invention.

Figure 5:
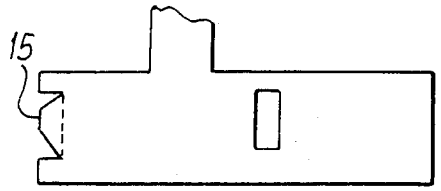
FIGS. 5 and 6 are plan views of blank cut out from flexible sheet metal in order to make connectors in accordance with the invention.
Figure 7:
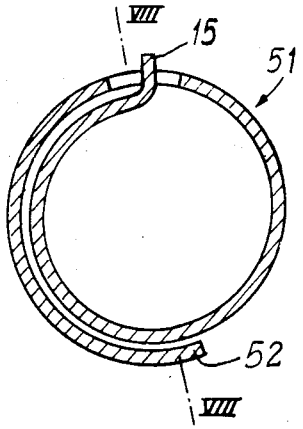
FIGS. 7 and 8 are a perpendicular and an axial section respectively through a connector made using the FIG. 5 blank.
Figure 8:
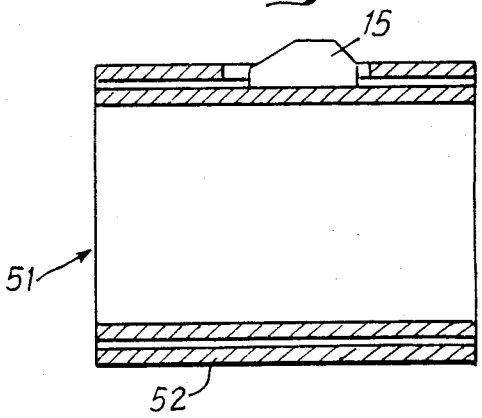
Figure 9:
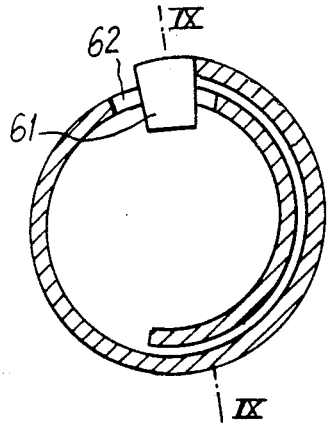
FIGS. 9 and 10 are views similar to FIGS. 7 and 8 but relating to the FIG. 6 blank.
Figure 10:
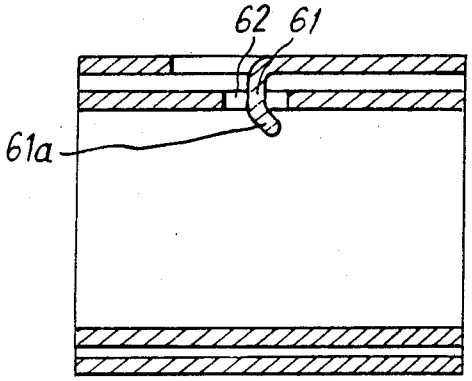

The blank shown in FIG. 5 is similar to that shown in FIG. 1. FIGS. 7 and 8 show a connector 51 made by rolling the FIG. 5 blank into a spiral and placing the tab-carrying end of the rectangle on the inside of the spiral. This provides a male connector which is capable of exerting an outwardly directly force between the edge of the tab 15 and the outside edge 52 of the spiral. The connector can thus be inserted and wedged in a tubular terminal by virtue of a suitably shaped cutout for the tab 15 having slopes similar to those shown for the tab 5 in FIG. 3.

Figure 6:
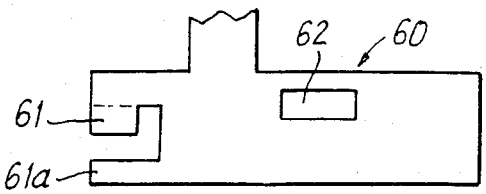

The blank 60 shown in FIG. 6 has a tab 61 formed by folding in a direction perpendicular to the connector axis. As a result, the window 62 is smaller in the axial direction but larger in the circumferential direction. This gives rise to less weakening of the resilient force of the spiral, and is thus advantageous for embodiments having spirals of one and a half turns or more since in such cases the window is included in the portion of the spiral which constitutes an active spring. The end 61*a* of the tab 61 is folded to facilitate engagement and snap fastening.

Figure 12:
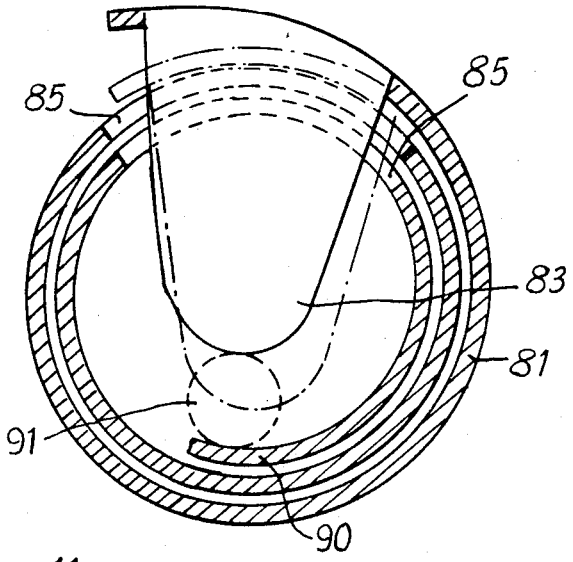
FIG. 12 is a perpendicular section through a connector made from the FIG. 11 blank.
Figure 11:
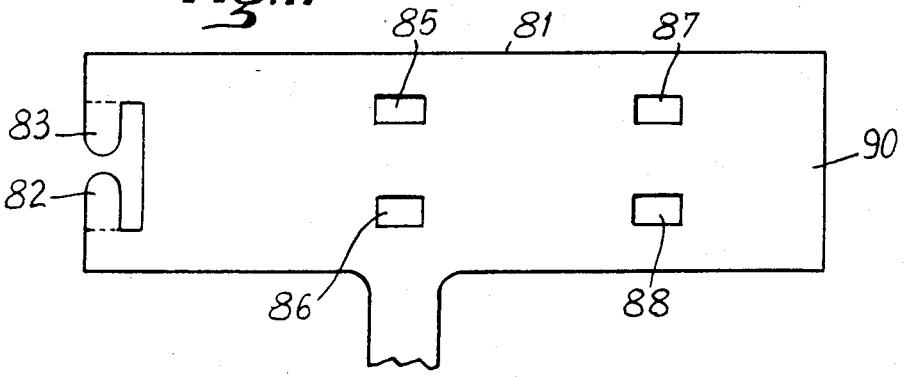
FIG. 11 is a plan view of a further connector blank cut out from flexible sheet metal.

The blank 81 shown in FIG. 11 extends the folded-tab technique of the blank 60 to include a pair of tabs 82 and 83. Further, the blank 81 is long enough to constitute a two and one half turn connector, and thus has two windows for each tab. In particular the tab 82 passes through windows 86 and 88, while the tab 83 passes through windows 85 and 87. The effect of having a two and one half turn connector is increased resilience, thus constituting a connector suitable for receiving a wide range of small-diameter terminals. FIG. 12 shows a terminal 91 clamped between the tabs 82 and 83 and the opposite end 90 of the blank. Because of the small size, and consequent weakness, of terminals 91 (which may simply be constituted by a stripped end of fine wires), the tabs 82 and 83 are preferably lifted outwardly to leave a free passage for the terminal to enter the connector and are then released to clamp the terminal once in place.

I claim:

1. An electrical terminal connector, comprising: a tubular contact member suitable for being removably fixed by elastic deformation to an electrical terminal, said member being formed by rolling a substantially rectangular blank of flat sheet metal so that its ends overlap in order to form a substantially spiral winding, a tab defined close to one end of the spiral winding and bent to extend through a window cut through an adjacent turn of said winding, the length of the tab being sufficient to radially project from a face of the tubular member formed by the spiral winding in such a manner as to ensure intimate contact with said electrical terminal, the window being sufficiently wide in a circumferential direction to enable the tab to move from side to side as the spiral winding is tightened or loosened, and the spiral winding including n and one half turns, wherein n is a whole number, such that said terminal is engaged by an end of the tab and by an opposite end portion of the winding diametrically opposite the tab with the full length of the intervening n and one half turns serving as a retention spring.

2. An electrical connector according to claim 1, wherein the tab projects beyond the window by a distance which is not less than the thickness of the metal blank constituting the connector.

3. A electrical connector according to claim 1, wherein the tab has an insertion slope at an angle of 20° to 40° to the axis of the connector.

4. An electrical connector according to claim 1, wherein the tab has a snap-fastening slope at an angle of 40° to 90° with the axis of the connector, and preferably at an angle of 40° to 60°.

5. An electrical connector according to claim 1, wherein the width of the window in the direction perpendicular to the axis of the connector is equal to not less than the sum of the circumferential width of the tab plus three times the distance by which the tab projects proud from the window.

6. An electrical connector according to claim 1, wherein the length of the window parallel to the axis of the connector is not greater than one third of the length of the connector.

7. An electrical connector according to claim 1, wherein the tab is cut out from an outer end of the spiral winding and is folded inwardly.

8. An electrical connector according to claim 1, wherein the tab is cut out from an inside end of the spiral and is folded outwardly.

* * * * *